United States Patent [19]

Stroup

[11] Patent Number: 4,610,247

[45] Date of Patent: Sep. 9, 1986

[54] COLD WEATHER BREATHING APPARATUS

[75] Inventor: Bert R. Stroup, Chula Vista, Calif.

[73] Assignee: Arctic Temperature Controls, San Diego, Calif.

[21] Appl. No.: 652,262

[22] Filed: Sep. 20, 1984

[51] Int. Cl.[4] ..... A62B 7/00

[52] U.S. Cl. ..... 128/201.28; 128/201.22; 128/204.17; 128/207.13

[58] Field of Search ..... 128/201.28, 201.13, 128/201.22, 201.11, 204.17, 207.13; 2/9, 202

[56] References Cited

U.S. PATENT DOCUMENTS

| | | | |
|---|---|---|---|
| 2,344,920 | 3/1944 | Maggi | 128/204.17 |
| 2,468,383 | 4/1949 | Tiffany | 128/201.13 |
| 3,271,781 | 9/1966 | Sontag et al. | 2/202 |
| 3,740,767 | 6/1973 | Schuessler | 2/173 |
| 3,768,100 | 10/1973 | Colman et al. | 2/9 |
| 3,818,510 | 6/1974 | Romann | 2/9 |
| 3,878,563 | 4/1975 | Pulju | 2/9 |
| 4,269,183 | 5/1981 | Hunt | 128/201.13 |
| 4,300,240 | 11/1981 | Edwards | 2/206 |
| 4,412,537 | 11/1983 | Tiger | 128/204.17 |
| 4,441,494 | 4/1984 | Montalbano | 128/204.17 |

*Primary Examiner*—Henry J. Recla

*Attorney, Agent, or Firm*—Baker, Maxham & Jester

[57] ABSTRACT

An air heater ski mask having apparatus to preheat incoming air. The ski mask comprises a cold weather protective hood adapted to fit over the wearer's head, and having eye and mouth openings. The breathing apparatus fits within the hood and is configured to permit a helmet to fit over the wearer's head when the hood is in place. The breathing apparatus fits within the hood and is elongated, having an intake positioned behind the wearer's ear where the air is relatively warm. The intake air passes through an intake valve to a nose piece and exhaust air exits through an exhaust valve adjacent to the nose piece. An exhaust tube surrounds a portion of the intake tube to preheat incoming air.

11 Claims, 4 Drawing Figures

COLD WEATHER BREATHING APPARATUS

FIELD OF THE INVENTION

This invention relates generally to cold weather wearing apparel and more particularly to a ski mask type cold weather breathing apparatus.

DISCUSSION OF THE PRIOR ART

When it is necessary to live and work in conditions of extreme cold, precautions to prevent frostbite become a necessity, particularly for a person's face, neck and ears. Many different designs for face masks have been proposed for protection of the face under such cold environmental conditions. The facial protective wear previously known generally seek to provide insulation and protection against cold weather and wind in coordination with other apparel.

While many of the prior art devices are effective to protect the exposed portions of the face, neck and ears from extreme cold, together with providing adequate visibility through some type of transparent eye protective device, little attention has been given to protecting the user's lungs from intake of extremely cold air. This is important because it has been shown that inhalation of sub-zero air by a person can cause damage to the lungs and to the air passages leading to the lungs. Some attempts which have been made to address this problem do not adequately solve the concomitant problem of condensation which freezes at some location in the vicinity of the person's skin where frostbite can occur.

SUMMARY OF THE INVENTION

Broadly speaking, this invention relates to cold weather apparel, providing a face mask for protection of a person's face against extremes of low temperature and high wind velocity and at the same time providing means for preheating incoming air to prevent possible damage to the person's lungs and air passages.

A breathing apparatus is used in conjunction with a flexible hood which fits over the wearer's head and covers most of the face except for the eyes and mouth. The apparatus comprises a nose piece and an intake tube extending to a location behind the wearer's ear. This is because that location is normally the warmest area within the hood close to the wearer's head. The intake tube extends from behind the ear to a nose piece and the exhaust means extends from the nose piece rewardly, surrounding the intake tube for a portion of its length. The exhaust tube, by surrounding a portion of the intake tube, thereby further preheats the incoming air. The exhaust outlet is positioned at the side of the wearer's face and is so configured that there is no danger of ice and frost forming in a position where it could prove detrimental to the wearer. At the same time the exhaust outlet is sufficiently removed from the fresh air intake so that incoming air does not become contaminated.

Appropriate intake and exhaust valves are located adjacent the nose piece and means are provided to secure the breathing apparatus in the hood so that it cannot easily become dislodged.

BRIEF DESCRIPTION OF THE DRAWING

The objects, advantages and features of this invention will become more readily apparent from the following detailed description when read in conjunction with the accompanying drawing, in which.

DESCRIPTION OF THE PREFERRED EMBODIMENTS

Figure 1:
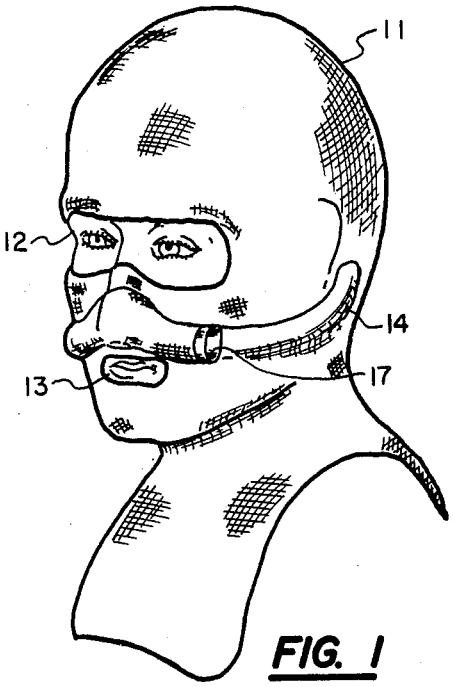
FIG. 1 is a perspective view of a cold weather hood having appropriate eye and mouth openings, showing the breathing apparatus of the invention positioned within the hood.

With reference now to the drawing, and more particularly to FIG. 1 thereof, there is shown a substantially conventional hood 11 extending over the wearer's head and having openings 12 for the eyes and 13 for the mouth. The hood extends completely over the wearer's ears and neck and partially over the front and back portions of the torso to allow the hood to integrate with other cold weather clothing so that no gaps can occur where cold may enter. The hood is normally a flexible stretch type knitted fabric. The mouth opening may be fitted with a closeable, removable flap if desired (not shown). The flap could be secured by suitable means such as a hook and pile fastener. Breathing apparatus 14 is shown in position inside hood 11.

Figure 2:
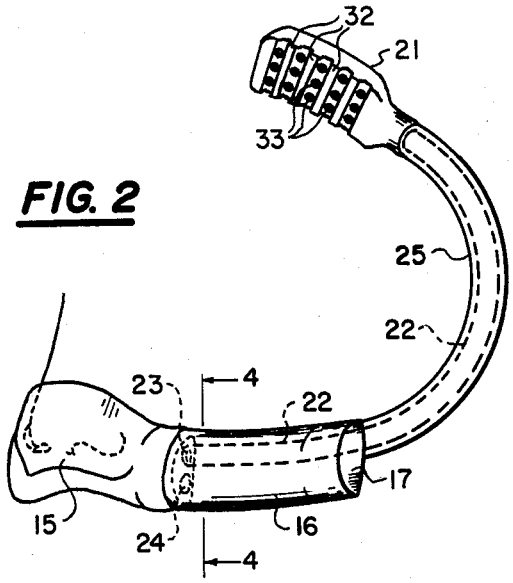
FIG. 2 is a perspective view of a portion of the breathing apparatus of FIG. 1.
Figure 4:
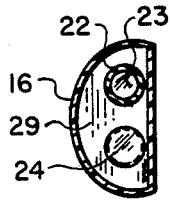
FIG. 4 is a sectional view of the breathing apparatus taken along cutting plane 4—4 of FIG. 2.
Figure 3:
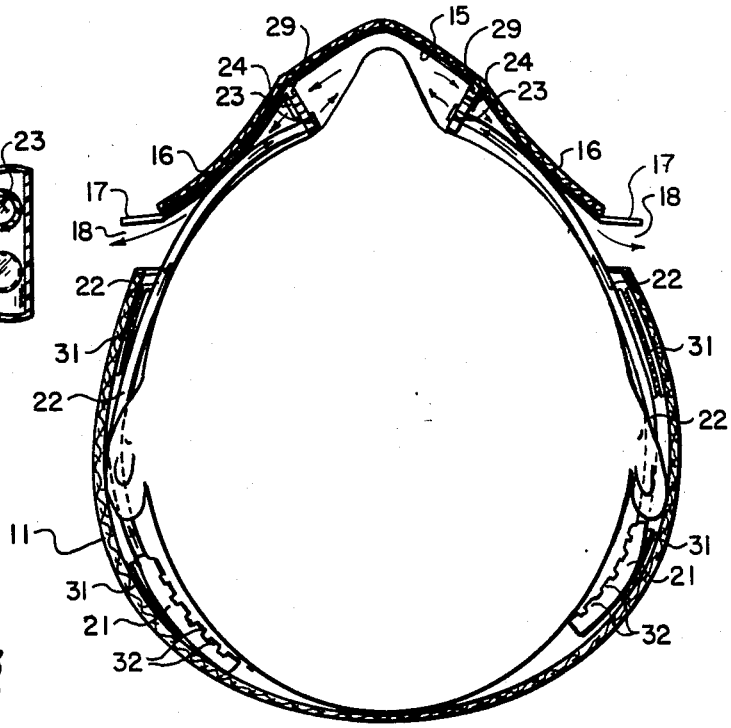
FIG. 3 is a top cross sectional view of the breathing apparatus of FIG. 2 with relation to the wearer's head.

Breathing apparatus 14 is shown in detail in FIGS. 2–4. Nose piece 15 encloses the forward portion of the nose including the nostrils. This is designed to fit easily over the nose so that exhaust air leaves the vicinity of the nose by means of the exhaust tube rather than escaping around the nose piece. Such undesired escape of exhaled air could potentially result in freezing of part of the mask because of the moisture in the exhaled air. Exhaust air tube 16 is coupled to the nose piece and has an exhaust outlet 17 located a short distance from the nose piece, typically about three inches. The hood is provided with an opening to accommodate exhaust opening 18 at the distal end of the exhaust tube. By having this opening through the hood, there is no danger of frost building up around the exhaust opening.

Fresh air intake means or element 21 is adapted to be positioned behind the wearer's ear where the air is relatively warm and couples to intake tube 22, a portion of which in turn passes through exhaust tube 16. The intake tube is also coupled to the nose piece. An appropriate one-way intake valve 23 ensures that the incoming air can only go through intake tube in one direction and one-way exhaust valve 24 requires that the exhaled air leave the nose piece by means of the exhaust tube. These valves prevent exhaled air from entering the intake tube and prevent the wearer from inhaling air through the exhaust tube which would be substantially colder than the air coming in the intake tube. To prevent the air entering the intake element 21 from cooling down substantially before entering nose piece 15, insulation 25 may surround either or both the intake tube and the exhaust tube. Alternatively, the insulation may only cover that portion of the breathing apparatus spaced from the wearer's head. The reason for insulation over the exhaust tube is to obtain the greatest heating effect possible on a heat exchange basis between the exhaust tube and the intake tube where they are coincident adjacent the nose piece. Separate insulation may not be necessary because it is envisioned that the breathing apparatus of this invention will be made of a relatively flexible plastic that is itself a good insulator. The walls of the plastic tubes may be of sufficient thickness to provide the desired insulation.

The drawing shows two intake means and tubes coupled to the nose piece. It is possible for the breathing apparatus to comprise a single intake and exhaust means on one side of the wearer's head.

The breathing apparatus will normally be secured to the hood by suitable means, such as being stitched directly to the hood, or a hook and pile fastener 31 may be used. It is possible that only one such fastener element would necessary at each location, because it would attach to the knitted fabric of the hood. It is envisioned that the material of which the hood is made will be of sufficient porosity to allow free flow of air to the intake means.

From the drawing it can be seen that the breathing apparatus of this invention has relatively thin walls and conforms to the contours of the wearer's head. The tubes are sufficiently flexible to enable one size breathing apparatus to fit nearly everyone, but are rigid enough so that the tube cannot collapse. Also the fresh air intake means positioned behind the ear may be formed with an uneven or waffled configuration so that even if the intake means fits closely against the wearer's head, air will easily pass into the intake tube. For this purpose, raised bars 32 are shown between holes 33 in FIG. 2. Because of its thin configuration, the breathing apparatus of this invention is aesthetically pleasing and enables the wearer to also wear a helmet for military or motorcycle purposes if desired. By having a mouth opening, the hood does not restrict speech or eating and the eye openings enable the wearer to also use standard goggles if desired. With the specific structure described above, the breathing apparatus of this invention will not freeze up with respect to the nose or mouth. Also, because it is relatively thin in cross section, it fits easily within the hood worn over the wearer's head and face and is functional for every day use because it is not bulky.

The coupling area between the nose piece and the tubes is shown in FIG. 4. Intake tube 22 terminates at wall 29 with intake valve 23. Exhaust tube 16 surrounds the intake tube and terminates in wall 29. Exhaust valve 24 provides access from the nose piece to the exhaust tube. The particular type and location of the valves is a matter of choice, but their one-way functions are constant.

It has been stated that the portion of the exhaust tube which surrounds the intake tube is approximately three inches long. This is an example only and the only requirements are that the exhaust outlet be adequately spaced from the intake means to prevent contamination of the incoming air, and that it be positioned so that frost formation does not become a problem. This is especially true if a helmet is worn where the exhaust must be more carefully separated from the intake means.

It is envisioned that the width of the intake means will be approximately two inches to allow adequate intake opening area and that the intake means will be approximately two and one-half inches long. However, these sizes are approximations only and significant variations may well be desirable under certain circumstances. The breathing apparatus while being flexible is not collapsible and is envisioned as being made of an appropriate plastic. This is true of the intake tube, the intake means, the exhaust tube and the nose piece. The insulation can be any appropriate material such as a cloth or some other fiber or it would be even a foam plastic of some type. The intake and exhaust valves are conventional elements and need not be described in detail here.

In view of the above description, it is likely that improvements and modifications will occur to those who are skilled in this art which are within the scope of the accompanying claims.

What is claimed is:

1. An air heater mask for a wearer, said mask comprising:

a hood of air permeable flexible material with an inner and an outer surface and having a closed upper end and an open lower end adapted to fit over the wearer's head; and a breathing apparatus secured within said hood and comprising:

a nose piece adapted to enclose the forward part of the wearer's nose, including the nostrils;

air intake means coupled to said nose piece comprising:

an air intake tube with an inward facing side and an outward facing side, said intake tube being secured within said hood such that said outward facing side contacts said inner surface of said hood between said closed end and said open end, said inward facing side of said intake tube is adapted to extend rearwardly in contact with and along the wearer's head beneath the ear; and air intake means at the rearward end of said intake tube, said intake means being shaped and configured to receive air from the surface of the wearer's head at the warm location behind the ear and having openings in said intake means adapted to be positioned to face and lie closely adjacent the wearer's head;

air exhaust tube means having one end coupled to said nose piece and defining an outlet at the opposite end thereof spaced from said nose piece;

said hood having aperture means for said outlet, said exhaust tube means extending therethrough;

said exhaust tube means between said exhaust outlet and said nose piece surrounding said intake tube to warm incoming air; and flow directional means providing one way flow through said intake means into said nose piece and through said exhaust tube means from said nose piece.

2. The heater mask recited in claim 1, wherein said flow directional means comprises a one-way exhaust valve between said nose piece and said exhaust tube means, said exhaust valve being adapted to allow exhaust air to pass through it but preventing incoming air to pass through from said exhaust tube means to said nose piece.

3. The heater mask recited in claim 1, wherein said flow directional means comprises a one-way intake valve connected between said nose piece and said intake means, said intake valve allowing air to pass from said intake means to said nose piece and preventing exhaled air from entering said intake means.

4. The heater mask recited in claim 1 and and further comprising insulation means at least on said outward facing side of said intake tube.

5. The heater mask recited in claim 1, and further comprising insulation means on at least the outward facing side of said exhaust tube.

6. The heater mask recited in claim 1, wherein when said breathing apparatus is positioned on the head of the wearer, said intake tube extends rearwardly below the wearer's ear, the cross section of said intake tube from the wearer's skin outward is relatively thin, substantially the same as the thickness of the wearer's ear, said breathing appartus, including said intake tube, has a curvature conforming to the wearer's head to thereby fit within said hood and prevent substantial interference with other head gear.

7. The heater mask recited in claim 1, wherein said hood is formed with a mouth opening to facilitate speech and eating irrespective of said breathing apparatus.

8. The heater mask recited in claim 1, wherein said hood is formed with eye openings to allow the wearer to wear goggles over the eyes.

9. The heater mask recited in claim 1, and further comprising means to retain said breathing apparatus in position within said hood adjacent the wearer's head.

10. The heater mask recited in claim 1, wherein said intake means comprises:

a first intake tube connected at one end to said nose piece;

a first intake element connected to the other end of said first intake tube;

a second intake tube connected at one end to said nose piece at a location spaced from said first intake tube; and a second intake element connected to the other end of said second intake tube.

11. The heater mask recited in claim 1, wherein said intake element is formed with means to prevent said openings from being blocked from free flow of air when said heater mask is positioned on the head of the wearer and said intake element contacts the wearer's head.

* * * * *